United States Patent [19]

Rousset et al.

[11] Patent Number: 4,842,019

[45] Date of Patent: Jun. 27, 1989

[54] PRESSURE COMPENSATOR DEVICE FOR PROPORTIONAL TYPE HYDRAULIC DISTRIBUTOR AND HYDRAULIC DISTRIBUTOR INCORPORATING SAME

[75] Inventors: André Rousset, Saint-Priest-en-Jarez; Maurice Tardy, Lorette, both of France

[73] Assignee: Bennes Marrel, France

[21] Appl. No.: 227,627

[22] Filed: Aug. 2, 1988

[30] Foreign Application Priority Data

Aug. 3, 1987 [FR] France ..... 87 11435

[51] Int. Cl.[4] ..... F15B 13/04

[52] U.S. Cl. ..... 137/614.2; 91/446; 137/501; 137/596

[58] Field of Search ..... 91/446; 137/501, 596, 137/596.13, 614.2

[56] References Cited

U.S. PATENT DOCUMENTS

| | | | |
|---|---|---|---|
| 2,600,702 | 6/1952 | Stephens | 137/596 X |
| 3,881,512 | 5/1975 | Wilke | 137/596.13 |
| 4,515,181 | 5/1985 | Dezelan | 137/596 |
| 4,649,951 | 3/1987 | Tardy | 137/596.13 X |
| 4,736,770 | 4/1988 | Rousset et al. | 137/596.13 X |

FOREIGN PATENT DOCUMENTS

| | | | |
|---|---|---|---|
| 2547889 | 5/1977 | Fed. Rep. of Germany | 137/596 |
| 224955 | 4/1975 | France . | |
| 2567233 | 1/1986 | France . | |
| 103115 | 6/1984 | Japan | 137/501 |

*Primary Examiner*—Gerald A. Michalsky
*Attorney, Agent, or Firm*—Remy J. VanOphem

[57] ABSTRACT

A proportional type hydraulic distributor incorporates a distributor slide valve including a feed chamber. It is provided with a pressure compensator device for regulating the feed pressure to the feed chamber according to the output (load) pressure of the slide valve. This device includes an inlet channel, an outlet channel communicating with the feed chamber and a stator communicating with the inlet and outlet channels. A compensator slide valve slides in a housing in the stator. A spring exerts an axial force on the compensator slide valve in the same direction as the force exerted on it by the output pressure and in the opposite direction to the force exerted on it by the feed pressure. An annular obturator member on the compensator slide valve isolates the inlet and feed channels and is acted on by a return spring on the compensator slide valve. The latter has a recessed part on which the obturator member slides without clearance. The obturator member slides between two abutment members and inside a cylindrical bore into which the feed channel opens. A chamber at the back of the housing contains the return spring and there is a passage through which the chamber communicates at all times with the feed chamber.

8 Claims, 3 Drawing Sheets

PRESSURE COMPENSATOR DEVICE FOR PROPORTIONAL TYPE HYDRAULIC DISTRIBUTOR AND HYDRAULIC DISTRIBUTOR INCORPORATING SAME

BACKGROUND OF THE INVENTION

1. Field of the Invention

The invention relates to a pressure compensator device adapted to be fitted to a proportional type hydraulic distributor provided with a passage for sensing the load pressure, and a hydraulic distributor incorporating the pressure compensator device.

2. Description of the Prior Art

A proportional type hydraulic distributor of this kind is described in French Pat. No. 2,562,632. The hydraulic distributor includes a distributor slide valve sliding in a bore in a stator that is actuated by at least one control pressure so that the slide valve, which has progressive action notches, moves across openings provided in the bore of the stator, being fed through a compensator slide valve, and, inside the stator, a pressure sensing passage which communicates at all times with the compensator slide valve spring chamber so as to superimpose on the action of this spring, on the compensator slide valve, the action of the pressure in this passage. The pressure sensing passage further communicates with at least one distributor chamber of the stator which the distributor slide valve causes to communicate alternately with the return circuit when the slide valve is in a neutral rest position or with a load circuit when the distributor slide valve feeds this circuit.

The usual commercial name for information sensing of this kind is "load sensing." The objective of a system of this kind is to transmit to a device adjusting the pressure of the installation the highest pressure required by the most heavily loaded equipment. This makes it possible to adjust the pressure of the circuit to the precise value needed to feed the various equipment loads that it controls.

To this end the hydraulic distributor of the aforementioned patent features a fluid flow rate to the main slide valve that is regulated by a compensator or balancing slide valve, the position of which depends on the value of the load pressure in the sensing passage. Inside the balancing slide valve is a check valve to prevent any possibility of reverse movement of a receiver. Reverse movement of this kind would tend to arise if a receiver were subjected to a fore against which a displacement is to be made, especially if the pump feeding the circuit has not yet reached the pressure needed to overcome this force.

Generally speaking, it is found that this structure is fully satisfactory for operation at moderate feed rates. However, when the flow rate reaches high values the head losses across the compensator slide valve become very high and they affect the efficiency of the distributor.

An object of the present invention is to avoid these disadvantages by proposing a new arrangement for the compensator slide valve.

SUMMARY OF THE INVENTION

In one embodiment, the invention is a pressure compensator device for a proportional type hydraulic distributor having a stator housing wherein is mounted a distributor slide valve in a feed chamber of the housing. The feed chamber further defines a feed channel and a feed pressure from an external source exists within the chamber. An output channel extends from the feed chamber and has an output pressure adapted to communicate with the feed chamber. The compensator slide valve is slidably mounted in the stator housing for communication with the inlet and outlet channels. A spring mounted at one end of the compensator slide valve exerts an axial force on the compensator slide valve in the same direction as the force exerted on it by the output pressure in the outlet channel. Further, the force exerted by the spring is in the opposite direction to the force exerted on the compensator slide valve by the feed pressure. An obturator member on the compensator slide valve is selectively adapted to isolate the inlet channel and feed channel from the feed chamber. The compensator slide valve has a recessed part upon which the obturator member can slide without clearance between two abutment members. The feed channel opens into the bore inside which the obturator member can slide. A back portion of the stator housing has a back chamber which contains a return spring which acts on the obturator member. This back chamber communicates at all times with the feed chamber such that the device is adapted to regulate the feed pressure to the feed chamber according to the output pressure of the slide valve.

Preferred features of the invention include the following:

the passage is either in the stator around the housing for the compensator slide valve or in the annular obturator member;

the compensator slide valve includes a solid guide part and, between the guide part and the recessed part, an intermediate part having a diameter less than that of the bore but greater than that of the recessed part so as to form a shoulder serving as an abutment for the annular obturator member;

the compensator slide valve has at one end of the recessed part a bearing flange against which the return spring bears;

the device further includes a cylindrical chamber adjacent the recessed part defined by the annular obturator member and into which the return spring extends; and the passage opens into the back of the feed chamber.

In another embodiment, a proportional type hydraulic distributor has a stator housing wherein is located a distributor slide valve and a compensator slide valve. The distributor slide valve slides within a bore in the stator housing and has an annular feed chamber with control chambers into which respective ends of the distributor slide valve extend. The annular feed chamber has at least one output channel as well as a pressure measuring passage leading from the at least one output channel. Fluid is fed to the feed chamber by a pressure compensator device consisting of a compensator slide valve. The compensator slide valve sits within a bore of the stator housing with one end of the compensator slide valve residing in a rear chamber in the back of the housing. The compensator slide valve bore further has an inlet channel as well as a feed channel which selectively communicates with the feed chamber. Its spring mounted at the opposite end of the slide valve exerts an axial force on the compensator slide valve in the same direction as the force exerted on it by an output pressure and in the opposite direction to a force exerted on it by the feed pressure. An annular obturator member is mounted on the compensator slide valve and is adapted to isolate the inlet and feed channels while a return spring mounted in the rear chamber of the housing acts on the obturator member. The obturator member is mounted on a recessed portion of the compensator slide valve for movement relative thereto between two abutment members. The cylindrical bore within which the compensator slide valve is mounted selectively communicates with a feed channel while a passage from the rear chamber at all times communicates with feed chamber.

Other objects, features and advantages of the invention will become apparent to those skilled in the art from the following description given by way of a non-limiting example with reference to the appended drawings.

DETAILED DESCRIPTION OF THE PREFERRED EMBODIMENT

Figure 1:
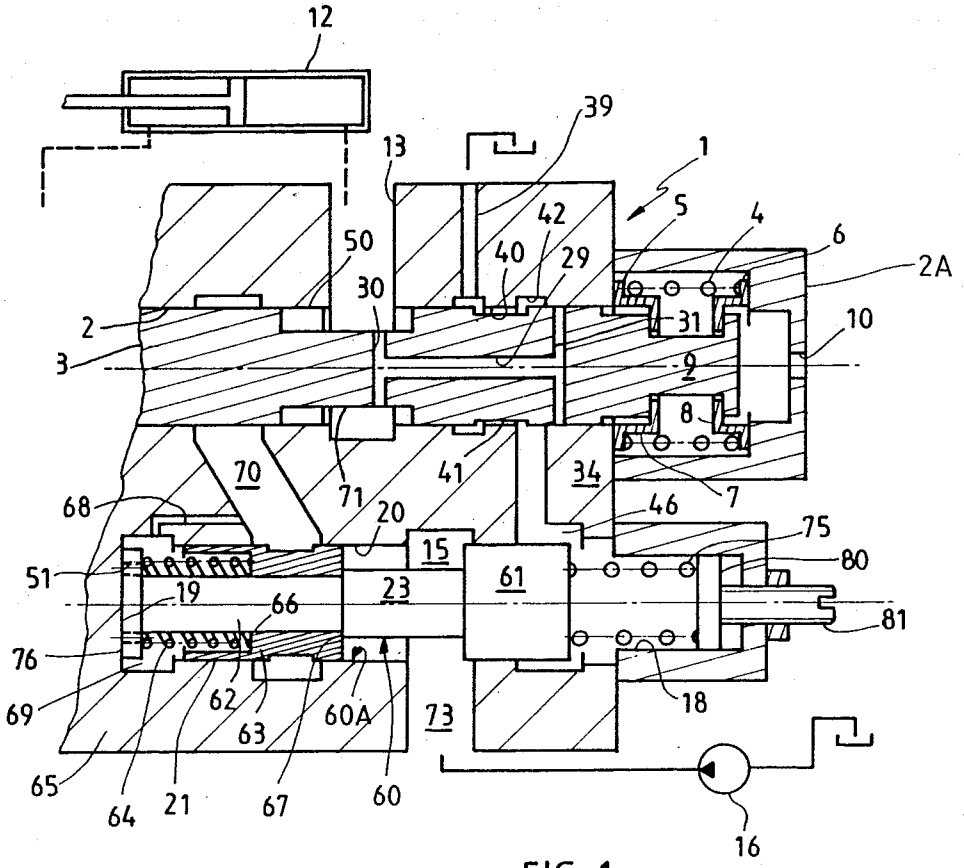
FIG. 1 is a partial view in longitudinal cross-section of a hydraulic distributor incorporating a pressure compensator device in accordance with the invention, shown in a neutral position.

The distributor shown in the drawings includes a stator 1 inside a bore 2 in which slides a cylindrical distributor slide valve 3. In the usual way, hydraulic circuits are switched by moving grooves in the slide valve 3 across openings in the stator.

Figure 2:
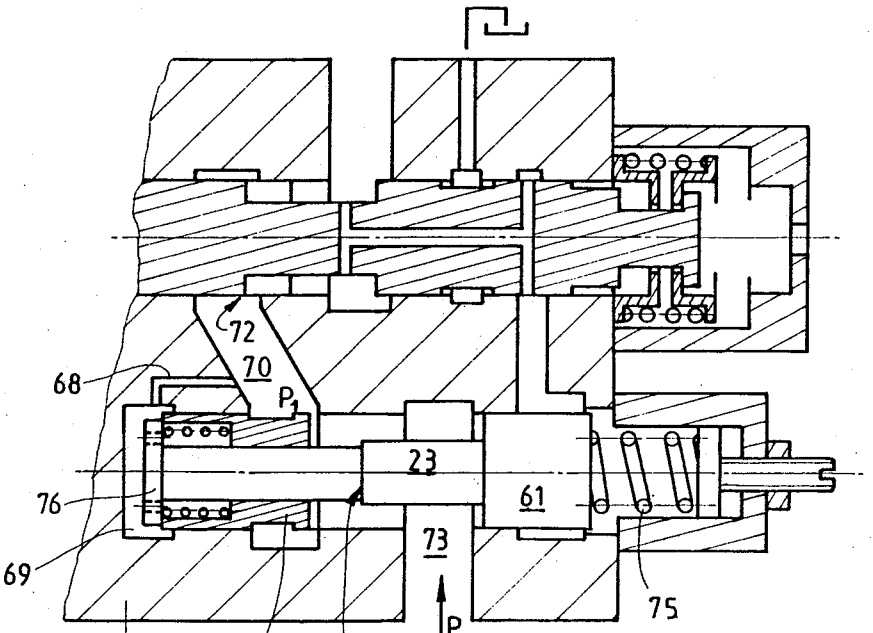
FIG. 2 is an analogous partial view of the device of FIG. 1 in an operative position.

At its righthand end, for example, the slide valve 3 is provided with a known type return spring device including a helical spring 4 compressed between cups 5 and 6 on two rings 7 and 8 trapped between two shoulders at the end 9 of the slide valve 3, about which they can slide. In its unoperated position the slide valve 3 is, therefore, drawn into the configuration shown in FIG. 1 whereas it is urged to the left as shown in FIG. 2 when control pressure is applied through an opening 10 in a fixed cap 2A coupled to the stator. On the other hand, it is urged to the right when control pressure is applied in the opposite sense.

In this example, it is assumed that the three-position slide valve 3 is used to control a double-acting hydraulic ram 12. To this end, one section of the ram 12 is connected to a first load channel 13 of the stator 1 and the opposite section of the ram 12 is connected to a second load channel of the stator 1 (not shown).

An annular feed chamber 15 in the distributor is at the pressure generated by a hydraulic generator 16.

The feed chamber 15 surrounds a compensator slide valve 60 which is acted upon by a compression spring 75 accommodated in a chamber 18. The spring urges the slide valve into abutting relationship with the fixed back 19 of the housing 60A, The spring 75 also bears against a base member 80, the position of which is adjustable by means of a calibration screw 81. An inlet channel 73 opens into the housing 60A, part of which consists in a bore 20 into which opens a feed channel leading to a feed chamber 70.

At each of its two ends the distributor slide valve 3 constitutes an axial internal opening, that at the right-hand end being denoted 29.

The opening 29 communicates with the exterior of the slide valve through two axially offset radial holes 30 and 31. The housing at the other end likewise discharges through two radial holes.

When the slide valve 3 is in its unoperated, neutral position (FIG. 1) the hole 31 faces a solid part 34 of the stator which blocks it off.

Between the holes 30 and 31 the stator defines within the bore a solid part 40 across which a groove 41 in the slide valve 3 can move.

An annular stator chamber 42 surrounds the slide valve 3 in the part situated around the hole 31 when the slide valve 3 is urged to the left, as shown in FIG. 2.

Similarly, at its opposite end the slide valve 3 has a groove movable across a solid part of the stator adjacent an annular stator chamber (not shown).

The two annular stator chambers are joined by a load sensing passage 46 which communicates at all times with the chamber 18 containing the return spring 75 for the compensator slide valve 60.

The groove 41 normally establishes communication between the load sensing passage 46 and a passage 39 which is part of the fluid return circuit.

Progressive action notches are provided on the various grooves in the slide valve 3, as indicated by the reference number 50, for example.

Appropriate means of any known type, not shown, are provided for evacuating fluid from the ram 12 to the flid return circuit at the appropriate time.

The compensator slide valve has a massive solid guide part 61 extended by a recessed part 62 on and around can slide an annular obturator member (or ring) 63 which slides in a fluid-tight way in the bore 20 and, at the end opposite the solid part 61, constitutes a housing 21 around the recessed part 62. A compression spring 64 bears at the one end on a bearing flange 76 terminating the slide valve 60 and at the other end on the back 66 of the housing 21 of the annular obturator member 63. The spring 64, therefore, tends to urge the annular obturator member 63 against a shoulder 67 through which the recessed part 62 merges with the remainder of the slide valve 60. The shoulder 67 constitutes one of the end of travel abutments of the obturator member 63.

The shoulder 67 preferably joins the recessed part 62 to a second recessed part 23, the diameter of which is between the diameter of the recessed part 62 and the transverse dimension of the solid guide part 61.

Balancing channels 51 are provided in the bearing flange 76.

A passage 68 in the stator housing 65 permanently connects a rear chamber 69 of the annular obturator member 63 (containing the spring 64) to the feed chamber 70 of the main slide valve 3, upstream of a constriction 72 which forms in operation with a distribution groove 71 (FIG. 2). The fluid from the inlet channel or feed orifice 73 (arrow 74) in the feed chamber 15 of the compensator slide valve 60 is, therefore, directed to the feed chamber 70, passing in the FIG. 2 configuration through a large annular cross-section. Without changing the overall dimensions of the prior art compensator slide valve, a significant reduction in the head losses on passing through the pressure compensator slide valve 60 has been achieved.

Figure 3:
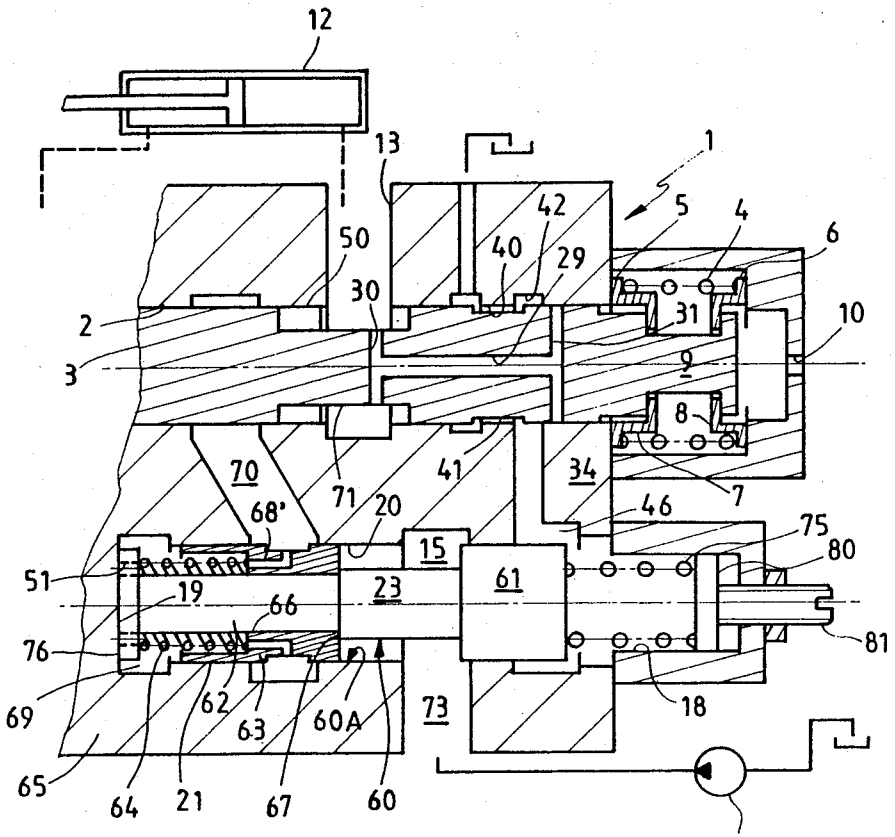
FIG. 3 is a partial view in longitudinal cross-section analogous to that of FIG. 1 showing an alternative embodiment of the distributor.

In the FIG. 3 embodiment, communication between the rear chamber 69 of the annular obturator member and the feed chamber 70 is established by a passage 68'.

Operation is as follows.

When the system is in the neutral configuration (FIG. 1) the pressure P1 of the fluid trapped in the feed chamber 70 is applied through the passage 68 or 68' to the rear chamber 69 where it produces a force which holds the annular obturator member 63 against the shoulder 67 of the slide valve 60. In this position fluid is prevented from flowing from the feed chamber 70 to the feed orifice 73, at which the pressure is the feed or inlet pressure PE. There can, therefore, be no flow in the reverse direction.

If the pressure difference (PE−P1) applied to the annular obturator member 63 corresponds to a thrust slightly greater than the calibration of the spring 64, the annular obturator member 63 moves to the FIG. 2 position, in abutting relationship against the lefthand bearing flange 76 of the slide valve 60. The feed chamber 70 is exposed to the pressure PE through a relatively large cross-section, due in particular to the small diameter of the second recessed or intermediate part 23, and the fluid flows with reduced head losses. Given the differences in cross-section subjected to this pressure PE, the slide valve 60 tends to move to the right.

When PE is greater than P1, the slide valve 60 fulfills its normal regulator role, given the pressure in the load sensing passage 46. It moves against the action of the spring 75 to secure a constant pressure drop in the feed notches of the distributor slide valve 3.

It will be apparent to those skilled in the art that suitable modifications and variations may be made to the present invention without departing from what is regarded as the scope of the invention, which invention is to be limited only by the terms of the following claims.

What is claimed is:

1. A pressure compensator device for a proportional type hydraulic distributor comprising a stator; a distributor slide valve; a feed chamber for said slide valve, said feed chamber defining a feed channel and being at a feed pressure; an inlet channel; an outlet channel having an output pressure adapted to communicate with said feed chamber; a housing in said stator for communicating with said inlet and outlet channels; a compensator slide valve slidable in said housing; a spring exerting an axial force on said compensator slide valve in the same direction as a force exerted on it by said output pressure and in the opposite direction to a force exerted on it by said feed pressure, an annular obturator member on said compensator slide valve adapted to isolate said inlet channel and feed channel; a return spring on said compensator slide valve acting on said obturator member; a recessed part of said compensator slide valve on which said obturator member can slide without clearance; two abutment members between which said obturator member can slide; a cylindrical bore inside which said obturator member can slide and into which said feed channel opens; a back in said housing; and a back chamber in said back of said housing containing said return spring and a passage through which said back chamber communicates at all times with said feed chamber whereby said device is adapted to regulate said feed pressure to said feed chamber according to said output pressure of said slide valve.

2. Device according to claim 1, wherein said passage is in said stator around said housing for said compensator slide valve.

3. Device according to claim 1, wherein said passage is in said annular obturator member.

4. Device according to claim 1, wherein said compensator slide valve includes a solid guide part and between said guide part and said recessed part an intermediate part having a diameter less than that of said bore but greater than that of said recessed part so as to form a shoulder serving as an abutment for said annular obturator member.

5. Device according to claim 1, wherein said compensator slide valve has at one end of said recessed part a bearing flange against which said return spring bears.

6. Device according to claim 1, further comprising a cylindrical chamber defined by said annular obturator member adjacent said recessed part into which said return spring extends, said cylindrical chamber being adapted to receive said return spring.

7. Device according to claim 6, wherein said passage opens into said cylindrical chamber.

8. Proportional type hydraulic distributor comprising a stator; a distributor slide valve; a bore in said stator in which said distributor slide valve slides; an annular feed chamber in said stator; at least one output channel; a pressure measuring passage leading from said at least one output channel; control chambers into which respective ends of said slide valve extend; and a pressure compensator device through which fluid is fed to said feed chamber, said pressure compensator device comprising a stator; a compensator slide valve; a housing in said stator in which said compensator slide valve slides; a back in said housing; an inlet channel; a feed channel opening into said feed chamber; said housing communicating with said inlet and feed channels; a spring exerting an axial force on said compensator slide valve in the same direction as a force exerted on it by said output pressure and in the opposite direction to a force exerted on it by said feed pressure; an annular obturator member on said compensator slide valve adapted to isolate said inlet and feed channels; a return spring on said compensator slide valve acting on said obturator member; a recessed part of said compensator slide valve on which said obturator member can slide without clearance; two abutment members between which said obturator member can slide; a cylindrical bore inside which said obturator member can slide and into which said feed channel opens; and a back chamber at said back of said housing containing said return spring and a passage through which said back chamber communicates at all times with said feed chamber.

* * * * *

UNITED STATES PATENT AND TRADEMARK OFFICE

CERTIFICATE OF CORRECTION

PATENT NO. : 4,842,019

DATED : June 27, 1989

INVENTOR(S) : Rousset et al

It is certified that error appears in the above-identified patent and that said Letters Patent is hereby corrected as shown below:

Column 1, line 49, delete "fore" and insert ---- force ----.

Column 3, line 10, after "with" insert ---- the ----.

Column 4, line 29, delete "flid" and insert ---- fluid ----.

Column 4, line 32, after "around" insert ---- which ----.

Signed and Sealed this

Nineteenth Day of February, 1991

*Attest:*

HARRY F. MANBECK, JR.

*Attesting Officer*

*Commissioner of Patents and Trademarks*